US005128211A

United States Patent [19]

Tesdahl et al.

[11] Patent Number: 5,128,211

[45] Date of Patent: Jul. 7, 1992

[54] ALUMINUM BASED PHOSPHATE FINAL RINSE

[75] Inventors: Thomas C. Tesdahl; Charles Ficker, both of Cincinnati; Michael Askren, West Chester, all of Ohio

[73] Assignee: Diversey Corporation, Mississauga, Canada

[21] Appl. No.: 662,759

[22] Filed: Feb. 28, 1991

[51] Int. Cl.[5] ..... C23C 22/83; C23C 9/00

[52] U.S. Cl. ..... 428/472.3; 428/472; 428/472.1; 428/172.2; 428/696; 428/697; 428/702; 148/256; 148/259

[58] Field of Search ..... 428/702, 704, 472, 472.1, 428/472.2, 472.3, 696, 697; 106/14.14; 148/256, 259

[56] References Cited

U.S. PATENT DOCUMENTS

| | | | |
|---|---|---|---|
| 3,857,723 | 12/1974 | Haskell et al. | 428/696 |
| 3,877,998 | 4/1975 | Guhde | 148/259 |
| 4,039,353 | 8/1977 | Kulick et al. | 148/259 |
| 4,097,287 | 6/1978 | Ito et al. | 106/14.14 |
| 4,182,637 | 1/1980 | Otrhalek et al. | 106/14.14 |
| 4,298,404 | 11/1981 | Greene | 106/14.14 |
| 4,376,000 | 3/1983 | Lindert | 106/14.11 |
| 4,497,666 | 2/1985 | Schapira et al. | 148/259 |
| 4,650,526 | 3/1987 | Claffey | 148/259 |

FOREIGN PATENT DOCUMENTS

| | | | |
|---|---|---|---|
| 0288258 | 10/1988 | European Pat. Off. | 428/472.2 |

OTHER PUBLICATIONS

Ron Zurilla et al: Phosphate Final rinse Options, Pretreat '90, pp. 4-1 thru 4-18.

*Primary Examiner*—Ellis P. Robinson
*Assistant Examiner*—Frank Rosenberg
*Attorney, Agent, or Firm*—Wood, Herron & Evans

[57] ABSTRACT

A final rinse for a phosphatized metal surface includes a phosphoric acid solution including aluminum chlorohydrate. The aluminum chlorohydrate solution is applied at a concentration of about 100 to about 1500 ppm at a pH of 3 to about 4.5. The pH is obtained by controlling the concentration of the phosphoric acid. This is preferably used to coat previously phosphatized metal surfaces such as iron, steel, aluminum and galvanize.

9 Claims, No Drawings

ALUMINUM BASED PHOSPHATE FINAL RINSE

BACKGROUND OF THE INVENTION

In the preparation of steel, iron, aluminum and galvanized surfaces for painting, the metal surfaces are frequently subjected to a pretreatment process referred to as phosphatizing. In this process, the metal surface is subjected to an alkaline cleaning, if necessary. It is subsequently rinsed, coated or immersed in a solution f a phosphatizing agent. Basically the phosphatizing agent is phosphate ion which may or may not contain additional metal salts. This dissolves a portion of the metal surface and forms phosphate salts on the surface. The phosphate salts act to prevent rust formation and improve adhesion of paint.

This does leave some voids in the phosphate coating which in the past have been eliminated or coated using a chromic acid final rinse. This eliminates the voids.

Unfortunately chromium presents an environmental hazard. Dispensing of the waste chromium causes significant problems and expenses. Further, chromium is dangerous to the worker.

There are many treatments for phosphatized metal surfaces. For example Guhde U.S. Pat. No. 3,877,998 and Kulick U.S. Pat. No. 4,039,353 disclose the use of a melamine formaldehyde composition. Linert U.S. Pat. No. 4,376,000 discloses another polymeric post-treatment and Schapira et al U.S. Pat. No. 4,497,666 discloses the use of a trivalent titanium compound. In a similar vein, Claffey U.S. Pat. No. 4,650,526 discloses treating a phosphated metal surface with an aqueous mixture of an aluminum zirconium complex comprising the reaction product of a chelated aluminum moiety, an organo functional ligand and a zirconium oxy halide. Zurilla in an article entitled "Phosphate Final Rinse Options" presented at "Pretreat 90" discloses a variety of different heavy metal, organic polymer, organic monomer, and inorganic post-treatments of phosphated metals.

Two important factors in selecting such treatments are cost and versatility. Many of these complexes are too expensive to effectively replace chromium. The various metallic complexes such as zirconium and the like tend to be relatively expensive. Versatility is also a significant function. One purpose of these treatments is to improve adhesion of paint to the treated surface and prevent the painted surface from rusting. Many polymeric coatings may function for treatment of surfaces which are to be coated with certain paints but not provide a good surface for other paints.

Environmental concerns are always significant. Although zirconium is not as objectionable as chromium, it is still a transition metal and it is preferable to avoid the use of transition metals.

SUMMARY OF THE INVENTION

Accordingly, it is an object of the present invention to provide a final rinse for a phosphatized metal surface which does not include chromium or other transition metals.

Further, it is an object of the present invention to employ such a final rinse which effectively fills voids on phosphatized surfaces and improves paint adhesion, is cost effective and useful for a wide variety of paints.

These objects are realized by rinsing a phosphatized surface with an aqueous acidic solution of aluminum chlorohydrate. The aluminum chlorohydrate which is environmentally acceptable and safe to use effectively fill voids in the phosphatized surfaces.

Further, the aluminum chlorohydrate acts to effectively improve adhesion of paints to the coated surface.

The objects and advantages of the present invention will be further appreciated in light of the following detailed description.

DETAILED DESCRIPTION

In a typical phosphatizing treatment, the metal surface which may be steel, iron, aluminum or a galvanized surface is first subjected to an alkaline wash. Generally, the metal surface is cleaned at a pH of 9 to 13 by spraying it with or dipping it into an aqueous alkaline solution such as sodium hydroxide. The solution can be heated if necessary and the time for the cleaning can vary depending on the dirt or residue on the metal surface. Generally, this may take anywhere from a matter of a few seconds to several minutes, such as 15 seconds to 5 minutes. The metal surface is then rinsed with tap water and a phosphatizing agent is applied.

The phosphatizing agent is generally an acidic aqueous solution of phosphate ion. The inorganic phosphate coatings may be any of those known in the art including zinc phosphate coatings, iron phosphate coatings, calcium phosphate coatings and mixed calcium-zinc phosphate coatings. Some phosphatizing baths include certain accelerators. These are all well known in the art. Accelerators that are acceptable for use in the present invention include sodium chlorate, sodium molybdate, sodium nitrobenzene sulfonate, sodium nitrate, sodium nitrite, hydroxyl amine sulfate, sodium borate, plus other metal or amine salts of the above. Depending on the paint, one skilled in the art will select an appropriate phosphatizing treatment and accelerator.

Particular phosphatizing agents which can be used are Bonderite sold by Parker and Secure sold by DuBois.

Accelerators that include molybdenum are less preferred since the molybdenum can interfere to a certain degree with the subsequent final rinse.

The alkaline cleaning step can be eliminated by using a phosphatizing agent formed from phosphate ion and a surfactant such as a modified ethoxylated alcohol. But this is simply an option to eliminate the alkaline cleaning step and is also well known.

After the phosphatizing step, the treated surface is rinsed with tap water and coated with an acidic solution of aluminum chlorohydrate. Aluminum chlorohydrate is also referred to as aluminum hydroxychloride, aluminum chloride hydroxide and aluminum chlorohydroxide. The commercial product is sold as 50% solution containing 23–24% $Al_2O_3$ and 7.5 to 8.5% Cl.

The solution of aluminum chlorohydrate should have a concentration of about 100 to about 1500 ppm aluminum chlorohydrate and a pH of about 3 to about 4.5. The pH is established preferably by phosphoric acid present in the solution.

The solution itself is formed by first establishing the pH within the desired range by adding phosphoric acid to water. Once the effective pH is established, the aluminum chlorohydrate is added. Generally the phosphoric acid is added as a 75% solution.

The article is treated by generally spraying the article with the solution. Alternately and less preferred, the article can be dipped into a container filled with the aluminum chlorohydrate solution. The aluminum chlorohydrate is applied at room temperature, generally 60°-80° F. and then the article is dried, preferably in a forced air oven at elevated temperatures.

Once dried, the article can then be coated with well known paints typically applied to phosphatized metal surfaces. These again are well known and form no part of the present invention.

EXAMPLES

To test the present invention, six identical steel test panels were subjected to an alkaline cleaning at a pH of about 13.5 at 140° F. for one minute. These were then rinsed for 30 seconds with fresh tap water and phosphatized with a solution of Secure brand phosphatizing agent at a pH of 5 at 140° F. for one minute. The surfaces were all then rinsed for 30 seconds. Two panels were then rinsed with a chromic acid rinse at 125 parts per million of chromium ion at a pH of 3.5 for 30 seconds. Two panels were rinsed for 30 seconds at ambient temperature with a solution of 1000 parts per million of aluminum chlorohydrate and two panels were not treated further.

All panels were then coated with a polyester powder paint and were then tested with salt spray according to ASTM B-117 in which the panels were exposed to a salt spray until 5 millimeters of creepage was observed from an "X" scribe. The untreated panel showed 5 millimeters rust mark at the "X" scribe after 360 hours. The chromium coated panels and the aluminum chlorohydrate coated panels both lasted for 840 hours before the exposure became apparent.

In order to test the compositions of the present invention and compare these with various treatments and related compositions, steel test panels phosphatized as described above, were coated with one of three paints. The paint listed number 1 is an epoxy based autobody primer. The paint listed number 2 is a polyester finish for metal office furniture and paint number 3 is an acrylic modified epoxy used for truck frames. In these tests, the phosphatized steel panels were treated as indicated and coated with the designated paint and then marked with an "X" scribe. They were placed in a salt vapor chamber for 120 hours. If the paint failed to adhere 10 cms or more from the scribe mark, it received a zero rating. If the paint adhered all the way to the "X" scribe, it received a rating of ten. A number marked with a negative or positive sign following the number indicates that the score for that panel was slightly greater or less than the number indicated.

| EXAMPLE | COMPOUND | CONCENTRATION | pH | PAINT | ASTM RATING (120 hours) |
|---|---|---|---|---|---|
| 1 | Aluminum chlorohydrate | 500 ppm Al | 3.98 | 1 | 7 |
| 1A | Aluminum chlorohydrate | 500 ppm Al | 3.98 | 2 | 7− |
| 1B | Aluminum chlorohydrate | 500 ppm Al | 3.98 | 3 | 5+ |
| 2 | Cavco Mod A (Al/Zr Complex) | 1:100 | 3.94 | 1 | 6− |
| 3 | Cavco Mod C (Al/Zr Complex) | 1:100 | 3.83 | 1 | 6− |
| 4 | Cavco Mod APG | 1:100 | 3.65 | 1 | 5 |
| 5 | Cavco Mod CPM | 1:100 | 3.60 | 1 | 5 |
| 6 | Poly Aluminum Chloride | 1:80 | 3.85 | 2 | 1+ |
| 6A | Poly Aluminum Chloride | 1:110 | 3.90 | 2 | 0 |
| 7 | $Al_2(SO_4)_3$ | 1:110 | 3.7 | 2 | 0 |
| 7A | $Al_2(SO_4)_3$ | 1:110 | 3.7 | 3 | 4− |
| 8 | $Al\ H_2PO_4$ | 1:100 | 2.65 | 2 | 0 |
| 8A | $Al\ H_2PO_4$ | 1:100 | 2.65 | 3 | 7− |

Cavco Mod A Amino functional zirco aluminate in lower alcohol
Cavco Mod APG Amino functional zirco aluminate in propylene glycol
Cavco Mod C Carboxylate functional zirco aluminate chloride
Cavco Mod CPM Carboxylate functional zirco aluminate chloride hydroxide The examples listed as number 1 demonstrate that the coating composition of the present invention at 500 parts per million aluminum functioned well with all three paints. This compares the present invention with a commercial product, the Cavco products, which are aluminum zirconium complexes and which are substantially more expensive than the aluminum chlorohydrate.

Examples 6, 7 and 8 are presented to demonstrate that other aluminum complexes do not work as well as the present invention. These compositions tested were polyaluminum chloride, aluminum sulfate and aluminum phosphonate. None of these aluminum compositions performed as well as the aluminum chlorohydrate.

Accordingly, the present invention provides a final rinse which is as effective as a chromium final rinse. This drastically improves the rust resistance relative to a phosphatized untreated surfaces. Since aluminum chlorohydrate is environmentally acceptable, it does not present problems with disposing of the waste treatment solution. Further it does not present a health hazard.

Thus, the present invention provides a unique method of coating articles wherein the articles have characteristics at least as good as the chromium treated materials, without the environmental problems.

The preceding has been a description of the present invention along with the preferred method of practicing the present invention.

However, the invention should only be defined by the appended claims wherein we claim:

1. A method of treating a phosphate treated metal surface selected from the group consisting of iron, steel, zinc and aluminum comprising rinsing said phosphate treated metal surface with an aqueous acidic solution comprising at least 100 ppm of aluminum chlorohydrate having an effective pH of from about 3 to about 4.5.

2. The method claimed in claim 1 wherein said solution includes from about 100 to about 1500 ppm of aluminum chlorohydrate.

3. The method claimed in claim 2 wherein said solution contains about 1000 ppm aluminum chlorohydrate.

4. The method claimed in claim 1 wherein said pH is about 3.5.

5. The method claimed in claim 1 wherein said acidic solution includes phosphoric acid.

6. The method claimed in claim 1 wherein said dilute acidic solution is applied by spraying.

7. The method claimed in claim 1 wherein said dilute acidic solution is applied by dipping said metal surface into said solution.

8. A metal article selected from the group consisting of iron, steel, zinc and aluminum and having a phosphatized surface, said article formed by coating said phosphatized surface with an acidic solution of aluminum chlorohydrate wherein said acidic solution of aluminum chlorohydrate includes from about 100 to about 1500 ppm of aluminum chlorohydrate and has an effective pH of from about 3 to about 4.5 and further includes phosphoric acid.

9. The article claimed in claim 8 wherein said article is subsequently painted.

* * * * *